US005528875A

United States Patent [19]

Ziegler, Jr. et al.

[11] Patent Number: 5,528,875

[45] Date of Patent: Jun. 25, 1996

[54] WOOD PLAY TOWER KIT

[75] Inventors: William H. Ziegler, Jr., Bedford; Gary L. Lochner, Imler, both of Pa.

[73] Assignee: Hedstrom Corporation, Bedford, Pa.

[21] Appl. No.: 331,371

[22] Filed: Oct. 27, 1994

[51] Int. Cl.[6] ..... E04B 1/38

[52] U.S. Cl. ..... 52/702; 52/712; 403/231

[58] Field of Search ..... 52/702, 712; 403/231, 403/237, 406.1

[56] References Cited

U.S. PATENT DOCUMENTS 5,109,646 5/1992 Colonias et al. ..... 52/712

5,274,981 1/1994 Commins ..... 52/712

5,380,116 1/1995 Colonias ..... 403/231

*Primary Examiner*—Creighton Smith

*Attorney, Agent, or Firm*—Cesari and McKenna

[57] ABSTRACT

A hardware kit for erecting a children's wood play tower of the type including a plurality of vertical support beams, a plurality of stretchers and a plurality of roof joists. The kit includes roof brackets, eave brackets and stretcher brackets and may include a multiplicity of fasteners for attaching the brackets to the beams comprising the play tower. The brackets are designed so that it is not necessary to notch or miter the beams in order to join the beams.

21 Claims, 2 Drawing Sheets

WOOD PLAY TOWER KIT

This invention to a children's play tower. It relates more particularly to a play tower or similar structure made of boards which are assembled using special metal brackets comprising a kit to form the finished tower.

BACKGROUND OF THE INVENTION

Wood play towers upon which children climb are normally made of a variety of different boards which are joined at various angles to form a sturdy erect structure. The structure usually includes a plurality of vertical support beams, a number of stretchers extending between the support beams to maintain the latter in spaced-apart relation and several joists for supporting a roof and one or more decks or floors.

Normally, in order to properly join the various beams, their ends should be mitered at various angles depending upon the overall shape of the structure. However, the wood beams are usually not provided with the other components of the play tower. Rather, the manufacturer supplies only brackets and fasteners and a set of instructions for making the structure. The purchaser, following the instructions, purchases the wood beams from a local lumber yard and cuts them with the correct miter angles in order to assemble the play tower. Since most customers do not possess a miter box or table saw, the cutting of the lumber can be a tedious and time consuming task. Even then, there is no assurance that the lumber will be cut with the proper angles. Resultantly, the assembled structures do not always have good joinary.

SUMMARY OF THE INVENTION

Accordingly, it is an object of the present invention to provide a children's play tower whose various beams can, for the most part, be assembled with squared off ends.

Another object of the invention is to provide a hardware kit for making a children's play tower which facilitates assembly of the wood components of the play tower.

Another object of the invention is to provide such a hardware kit whose components can be manufactured relatively easily and inexpensively.

Yet another object of the invention is to provide an improved wood play tower for children which can be assembled relatively easily without any special tools.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present hardware kit comprises a plurality of roof brackets, eave brackets, stretcher brackets and a multiplicity of fasteners for securing the brackets to the various beams comprising the play tower. The various brackets and fasteners are made of a strong rigid material such as steel.

Each roof bracket includes a generally rectangular base and a pair of mirror-image side walls extending from opposite side edges of the base. These side walls oppose one another and each makes an obtuse angle with the base. The side walls extend somewhat below the base and their lower ends are turned in to form shelves for supporting roof joists.

The roof bracket is shaped and arranged so that its base can be placed flush against the sides of a pair of butted roof joists and attachment means are provided in the base for attaching the base to the butted roof joists. Similar attachment means are provided in the side walls, including their shelves, for attaching the side walls to roof joists supported on the shelves. By mounting a pair of such roof brackets on opposite sides of the butted roof joists, four additional roof joists may be supported by the two roof brackets so that they all radiate out from the joint between the butted roof joists forming the skeleton of a peaked roof. If desired, the joists may be covered with suitable roofing material such as a canvas or plastic sheet, boards or the like.

Each eave bracket component of the kit includes a generally rectangular base and a pair of spaced apart parallel side walls extending from opposite side edges of the base. A tab is present at one end of the base which extends from the base in the opposite direction from the side walls. The bracket is arranged so that its base can be positioned flush against the end of a support beam with the tab overhanging and engaging the side of that beam such that the bracket side walls project out from the end of the beam. Attachment means are provided for attaching the base and tab to the support beam.

Each eave bracket is arranged to receive the sloping lower end segment of a roof joist and anchor the joist to the associated support beam. More particularly, the roof joist is engaged between the side walls of the eave bracket and attachment means are provided for attaching those side walls to the roof joist to securely anchor the lower end of that roof joist to the associated support beam.

The third component of the kit, namely the stretcher bracket, comprises a generally rectangular base having a pair of mirror-image side channels extending from opposite side edges of the base. The stretcher bracket is arranged to be positioned with its base flush against the rear face of a support beam and attachment means are provided for securing the base to that beam. When positioned thusly, the bracket's side channels are open at the top and are arranged to receive and support the ends of a pair of stretchers leading to that support beam. Attachment means are provided in the channel walls for attaching the channels to the stretchers so that the stretchers provide strong reinforcement to the support beam.

The attachment means for the various brackets may include suitable fasteners such as nails, bolts or screws driven through holes provided in the bases and walls of the brackets and into the associated joists and beams.

The kit for a typical hexagonal, gazebo-type structure may consist of two roof brackets, six eave brackets and twelve stretcher brackets for anchoring the stretchers that maintain the spacing between the upper and lower ends of the six vertical support beams comprising the structure. Additional stretcher brackets may be provided for anchoring floor or deck joists to the support beams.

Due to the design of the brackets comprising a kit, there is no need to notch or miter the various joists and beams in order to join them to erect the finished play tower, the one exception being the butted roof joists which are cut on a bias to establish the peak angle of the roof, e.g., 60°.

The subject kit thus greatly facilitates the erection a play tower or other structure composed of wood beams.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF ILLUSTRATIVE EMBODIMENT

Figure 1:
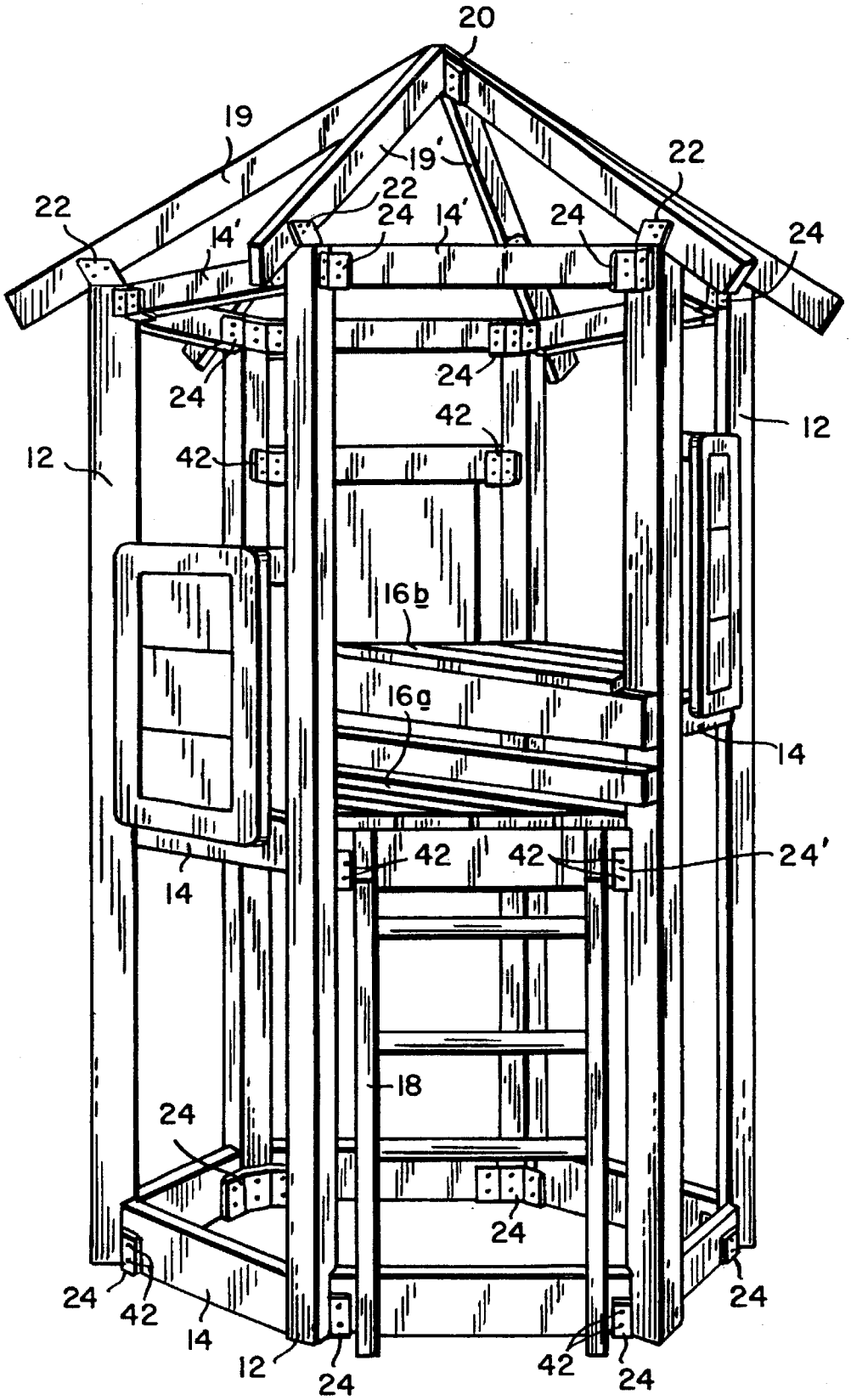
FIG. 1 is an isometric view of a children's play tower incorporating support brackets made in accordance with the invention.

Referring to FIG. 1 of the drawings, a children's wood play tower comprises a plurality of vertical support beams 12 (e.g., 4×4s) which are maintained in spaced relation at their lower ends by a plurality of stretchers 14 (e.g., 2×6s) and by smaller stretchers 14' (e.g., 2×4s) at the upper ends of those support beams. Additional stretchers may be present intermediate the ends of the support beams which may function as floor joists for one or more decks **16*a*, 16*b*. Also, in the illustrated tower, a wood ladder 18 with tubular steel rungs or just wood ladder rails extends from the ground up to the deck 16*a***.

The FIG. 1 play tower has a peaked roof comprising a plurality of roof joists 19 which are supported by support beams 12. Two of these beams 19', 19' lie in the same plane and their upper ends are cut on a diagonal and butted together to form a joint J (FIG. 2) so that the joists 19', 19' define an included angle of about 120°. All of the other roof joists 19 radiate out from joint J to the various support beams 12. As is apparent from FIG. 1, the illustrated structure is hexagonal so that it has six support beams 12 at the six corners of the structure and six roof joists which radiate out from joint J to the upper ends of those support beams.

Still referring to FIG. 1, the upper ends of the roof joists 19, 19' are secured together by a pair of roof brackets 20, only one of which is shown in FIG. 1. The joists 19, 19' are anchored near their lower ends to the upper ends of support beams 12 by a plurality of eave brackets 22, there being one bracket at each support beam. Finally, the various stretchers 14, 14' are secured at their opposite ends to support beams 12 by a plurality of stretcher brackets 24. In most cases, each stretcher bracket 24 anchors a pair of stretchers 14 or 14' to opposite sides of a support beam 12. However, in some cases, only one stretcher 14 or 14' may lead to a particular support beam in which case the stretcher bracket at that location may be cut in half as indicated by the bracket 24' that anchors the right end of the stretcher 14 at the top of ladder 18.

Figure 2:
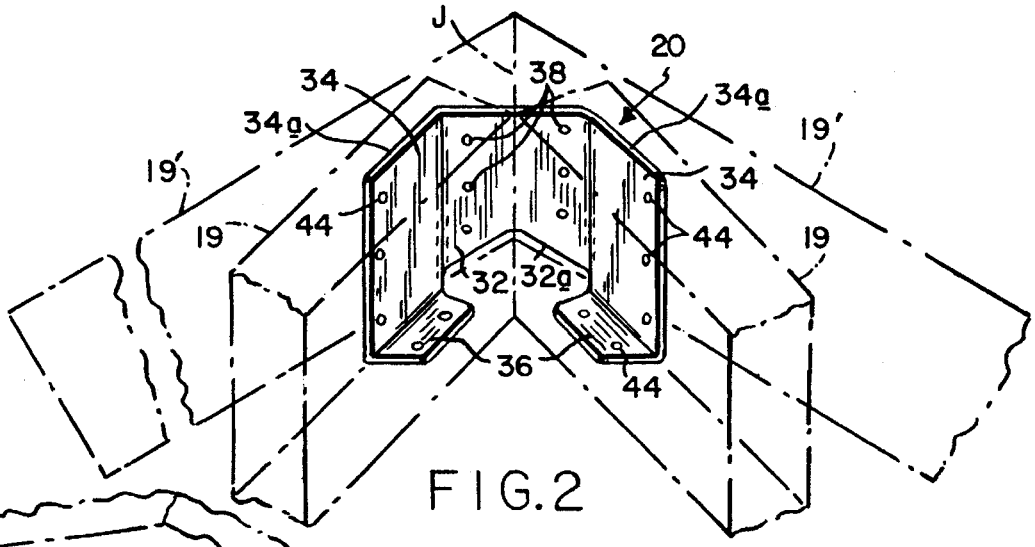
FIG. 2 is a front elevational view of a roof bracket in the FIG. 1 play tower.

As best seen in FIG. 2 of the drawings, each roof bracket 20 comprises a generally rectangular base 32 and a pair of mirror image side walls 34 which splay out from opposite side edges of base 32. In the illustrated bracket 20 designed for a hexagonal structure, base 32 defines with each side wall 34 an included angle of about 120°. Preferably, the side walls 34, 34 of bracket 20 extend somewhat below the lower edge **32*a* of base 32. Also, the lower edge margins of the side walls are turned toward one another to form a pair of shelves 36, 36. These shelves are tilted so that they lie at an angle of about 120° with respect to base 32**.

As shown in FIG. 2, bracket 20 may be positioned with its base 32 flush against the faces of the butted roof joist 19', 19' such that the base 32 spans the joint J between those joists as shown in phantom in FIG. 2. Also, means are provided for attaching base 32 to those joists. In the illustrated bracket, the attaching means comprise a column of fastener holes 38 located opposite each joist 19', 19' and a corresponding plurality of fasteners 42 (FIG. 1), e.g., nails or screws, driven through holes 38 into joists 19', 19'.

The bracket side walls 34, and more particularly their shelves 36 are arranged to support a pair of roof joists 19 as shown in phantom in FIG. 2. As noted above, each wall 34 defines an included angle of 120° with base 32 and each shelf 36 is inclined at an angle of about 120° with respect to the base, i.e., 60° from a horizontal plane. Therefore, when joists 19 are supported by bracket 20, they are inclined at the same angle as joists 19' and radiate out from joint J with an angular spacing between the joist of about 60°. Note that this precise positioning of the joists occurs without requiring any mitering of the joists; in other words, all of the joists 19 have squared off ends.

As seen in FIG. 2, attachment means in the form of fastener holes 44 are provided in the bracket side walls 34, including shelves 36, through which fasteners 42 (FIG. 1 ) may be driven into the joists 19 to firmly anchor the upper ends of those joists to the bracket 20 and to the butted roof joists 19', 19'.

Preferably, the upper edges **34*a* of side walls 34 are cut on a bias of about 60° so that they follow the angle of joists 19. Similarly, the lower edge 32*a* of base 32 is downwardly angled on each side of the base vertical centerline as shown so that both halves of the edge lie more or less parallel to the shelves 36. In this way, neither the base nor the sidewalls extends beyond the joists 19', 19'**.

When a pair of brackets 20 are secured to the opposite faces of the butted roof joists 19', 19' as shown in FIG. 1, four joists 19 may be anchored to joists 19', 19' all radiating out from joint J at equal angles of about 60°.

Figure 3:
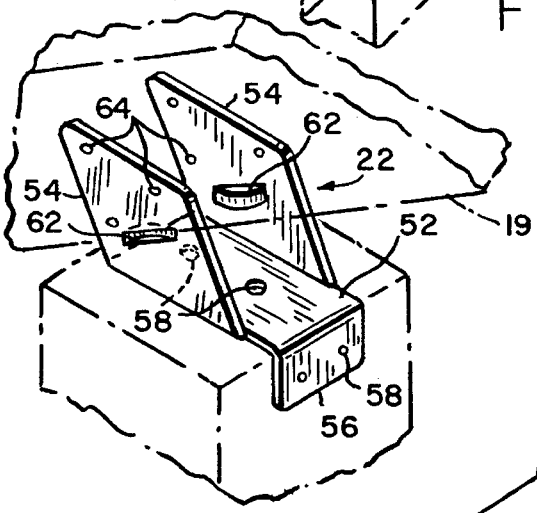
FIG. 3 is an isometric view of an eave bracket in the FIG. 1 play tower.

Referring now to FIG. 3, eave bracket 22 comprises a generally rectangular base 52 having a pair of mirror-image side walls 54 extending perpendicularly from the base. Also, a tab 56 projects from one end of base 52 in the opposite direction from walls 54. Preferably, tab 56 extends the entire width of the base. Preferably also, side walls 54 are formed as parallelograms which lean away from the end of base 52 containing tab 56.

In use, bracket 22 is positioned with its base flush against an end of a support beam 12, with tab 56 overhanging and engaging the inside face of that support beam. Attachment means in the form of fastener holes 58 are provided in base 52 and tab 56 for receiving fasteners 42 (FIG. 1) so as to anchor bracket 22 to the end of beam 12.

Each bracket 22 is arranged to snugly receive a roof joist 19 or 19' between its side walls 54. Preferably, as seen in FIG. 3, the side walls 54 of bracket 52 are punched to form a pair of linear ramps 62. These ramps are aligned with the outside end of the bracket base 52, i.e., the end opposite tab 56, and make an angle of about 60° with the base. As shown in phantom in FIG. 3, when a roof joist 19 or 19' is received between the side walls 54, it is seated on the ramps 62 so that the joist just clears the outer end of the bracket. Attachment means in the form of fastener holes 64 for receiving fasteners 42 (FIG. 1 ) are provided in walls 54 to fasten bracket 22 to the associated joist 19 or 19' When secured thusly, the bracket firmly anchors the associated joist to the corresponding vertical support beam 12 as shown in FIG. 1. Since the bracket side walls 54 lean away from the inside edge of base 52, a maximum amount of wall surface area is disposed opposite the joist 19 or 19'. Also, it may be seen from FIG. 1 that the tab 56 engagement against the inside face of the support beam 12 opposes force components directed along the length of the roof joist caused by downward forces on the roof.

Figure 4:
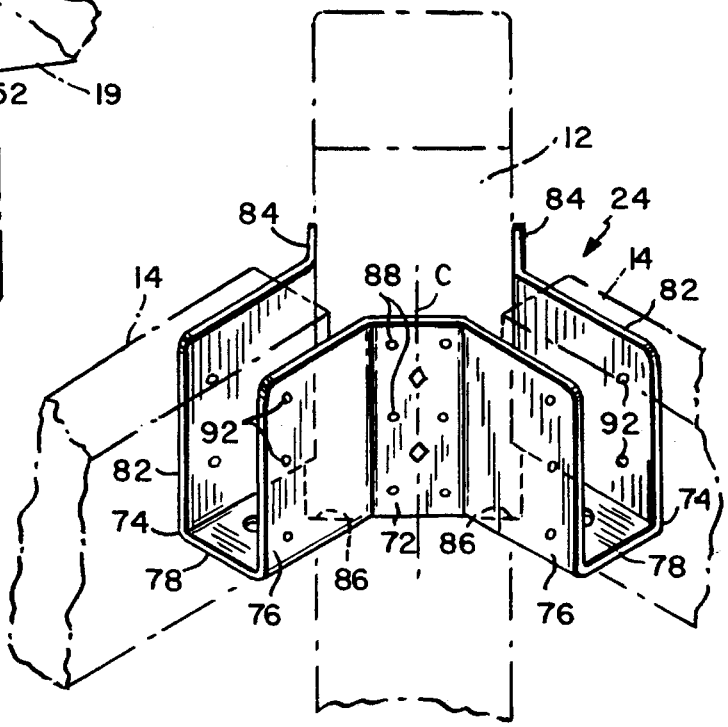
FIG. 4 is a similar view of a stretcher bracket in the FIG. 1 play tower.
Figure 5:
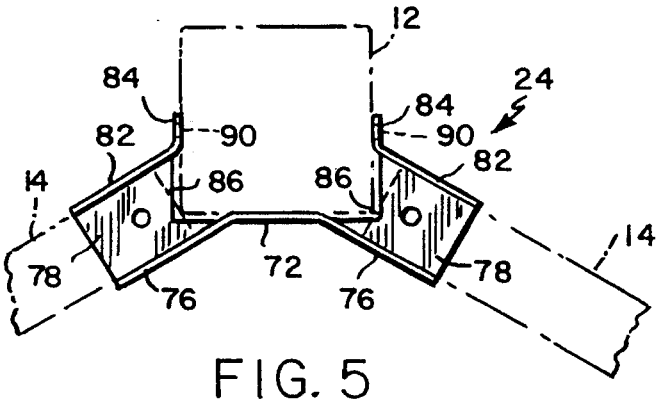
FIG. 5 is a top plan view of the stretcher bracket.

Refer now to FIGS. 4 and 5 which illustrate the stretcher bracket 24 used in the play tower depicted in FIG. 1. Each stretcher bracket comprises a generally rectangular base 72 and a pair of mirror image channels 74 extending out from opposite side edges of the base. Each channel 74 includes a generally rectangular inside wall 76 which is joined to base 72, a rectangular bottom wall 78 and a rectangular outside wall 82. Thus, each channel 74 has a generally U-shaped cross section and is open at the top. When used to construct the hexagonal play tower shown in FIG. 1, the inside wall 76 of each channel 74 defines with base 72 an included angle of about 120°.

As best seen in FIG. 5, the outside wall 82 of each channel is provided, at its end adjacent base 72, with a tab 84 which extends out more or less perpendicular to base 72. In addition, the end of each channel bottom wall 78 adjacent the corresponding tab 84 is provided with a right angle notch 86, the two edges of each notch extending parallel to the corresponding tab 84 and to base 72, respectively.

Bracket 24 is arranged to be positioned with its base 72 flush against the inside face of a support beam 12 such that corners of beam 12 are received in the two notches 86 in the channel bottom walls 78 as shown in FIG. 5. When positioned thusly, the tabs 84 of bracket 24 engage against the sides of beam 12. In order to attach base 72 to beam 12, fastener holes 88 are provided in base 72 for receiving fasteners 42 (FIG. 1). In the illustrated bracket 24, there are two columns of three fastener holes 88 located on opposite sides of the vertical centerline C of the bracket. Similar fastener holes 90 (FIG. 5) are provided in tabs 84 for attaching the tabs to the sides of the associated support beam 12.

The channels 74 of each bracket 24 are arranged to receive and support the end segments of a pair of stretchers 14 or 14'. As best seen in FIG. 5, the stretchers 14 or 14' may be positioned on bracket 24 so that their squared off ends are spaced close to the corners of the support beam 12. In order to attach the channels 74 of bracket 24 to the stretchers 14 or 14', a plurality of fastener holes 92 are provided in the side walls 76 and 82 of each channel. These holes 92 are arranged to receive fasteners 42 (FIG. 1) driven into the stretchers 14 or 14'.

When properly installed, each bracket 24 may connect a pair of stretchers 14 or 14' to a support beam 12 with the stretchers extending out about 30° from the support beam.

In those cases where it is desired to connect only one stretcher to a particular support beam, the bracket 24 illustrated in FIG. 4, and more particularly, the base 72 thereof, may be cut along the vertical centerline C to divide the bracket in two so that each half may form a bracket similar to bracket 24' in FIG. 1 which is capable of connecting one end of a stretcher 14 or 14' to a support beam 12. Also, of course, instead of having to cut a bracket 24 in half, left and right hand brackets 24' may be manufactured from the outset.

It should be apparent that all of the brackets 20, 22 and 24 are simple stamped metal parts which may be manufactured in quantity at relatively low cost. When provided as components of a kit along with a set of instructions, the brackets enable an average person to erect a structure such as the play tower depicted in FIG. 1 with minimum ado and without having to notch and miter the various wood beams comprising the structure.

It will thus be seen that the objects set forth above, among those made apparent from the preceding description, are efficiently attained. Also, it is apparent that certain changes may be made in the above construction without departing from the scope of the invention. For example, the various angles built into the brackets may vary depending upon the overall shape of the structure being erected. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A kit for erecting a children's play tower of the type including a plurality of vertical support beams, a plurality of horizontal stretchers and a plurality of roof joists two of which are in butted alignment to form a joint, said kit comprising a rigid roof bracket including a substantially continuous flat base for bridging said joint, said base having opposite side edges and a bottom edge and a pair of mirror-image side walls joined to said opposite side edges, each said wall making an obtuse angle with said base and having a lower edge;

first attachment means for attaching said base portion to said butted roof joists, and second attachment means for attaching said side walls to non-butted roof joists so that all of the roof joists radiate out from said joint.

2. The kit defined in claim 1 wherein said first attachment means include a plurality of fastener holes in said base and for facing said butted roof joists on both side of said joint, and said second attachment means include a plurality of fastener holes in each side wall.

3. The kit defined in claim 2 wherein each side wall includes an orthogonal shelf joined at an angle to the corresponding side wall lower edge, said shelves extending toward one another.

4. The kit defined in claim 3 wherein the plurality of fastener holes in each side wall include at least two fastener holes in each shelf.

5. The kit defined in claim 4 wherein said shelves are situated below said base bottom edge.

6. The kit defined in claim 4 wherein said first and second attachment means also include a plurality of fasteners extending through said fastener holes into said plurality of roof joists.

7. The kit defined in claim 4 wherein each shelf defines with said base an included angle of substantially 120°.

8. The kit defined in claim 1 wherein the angle between each side wall and the base is substantially 60°.

9. A kit for erecting a children's play tower, said kit including a plurality of vertical support beams each beam having a butt end, a plurality of horizontal stretchers, a plurality of roof joists and a rigid eave bracket, said rigid eave bracket including a flat, generally rectangular base having opposite side edges and an end and a pair of spaced-apart parallel side walls extending orthogonally from said base side edges, opposing joist seating means projecting from each side wall toward the other side wall, the spacing between said seating means being substantially the same as the width of said roof joist first attachment means for attaching the base to the butt end of a support beam, and second attachment means for attaching said side walls to a roof joist so that the roof joist is oriented at an acute angle with respect to the butt end of the support beam.

10. The kit defined in claim 9 wherein the first attachment means include a plurality of fastener holes in said base, and said second attachment means include a plurality of fastener holes in each side wall.

11. The kit defined in claim 9 wherein said joist seating means comprise ramps which make an angle with said base of substantially 60°.

12. A kit defined in claim 11 wherein said second attachment means and said base are positioned on opposite sides of said seating means.

13. The kit defined in claim 12 wherein said first and second attachment means also include a plurality of fasteners extending through said fastener holes.

14. A kit for erecting a children's play tower of the type including a plurality of vertical support beams, each beam having a butt end a plurality of horizontal stretchers and a plurality of roof joists, said kit comprising a rigid eave bracket including a flat, generally rectangular base having opposite side edges and an end and a pair of spaced-apart parallel side walls extending orthogonally from said base side edges;

first attachment means for attaching the base to a butt end of a support beam;

second attachment means for attaching said side walls to a roof joist so that the roof joist is oriented at an acute angle with respect to the butt end of the support beam;

an orthogonal tab extending from the base end edge in the opposite direction from said side walls and for engaging the support beam, and third attachment means in said tab for attaching said tab to the support beam.

15. The kit defined in claim 14 wherein the third attachment means comprise a plurality of fastener holes in said tab.

16. The kit defined in claim 15 wherein said side walls are parallelograms which slope away from said base end edge.

17. A kit for erecting a children's play tower of the type including a plurality of vertical rectangular support beams, a plurality of horizontal stretchers and a plurality of roof joists, said kit comprising a rigid stretcher bracket including a channel, said channel having a bottom wall and a pair of spaced-apart opposed parallel side walls extending from the bottom wall, said bottom and side walls having corresponding end edges at one end of the channel, said channel being arranged to snugly receive the end segment of a stretcher, means defining a notch in the end edge of the bottom wall, a base tab extending out from the end edge of one side wall, and a second tab extending out from the end edge of the other side wall substantially perpendicular to said base tab so that said tabs can engage adjacent sides of a support beam received in said notch;

first attachment means for attaching said tabs to the sides of a support beam, and second attachment means for attaching said side walls to a stretcher.

18. The kit defined in claim 17 wherein said first attachment means include a plurality of fastener holes in each of said tabs, and said second attachment means include a plurality of fastener holes in each of said side walls.

19. The kit defined in claim 18 wherein the first and second attachment means also include a plurality of fasteners extending through said fastener holes.

20. The kit defined in claim 17 wherein said stretcher bracket includes a second channel connected to said base tab so that it is a mirror image of the first channel.

21. A kit for erecting a children's play tower of the type including a plurality of vertical support beams each of said support beams having a butt end, a plurality of horizontal stretchers and a plurality of roof joists two of which are in butted alignment to form a joint, said kit comprising a rigid roof bracket including a flat base having opposite side edges and a bottom edge and a pair of mirror-image side walls joined to said opposite side edges, each said side wall making an obtuse angle with said base and having a lower edge;

first attachment means for attaching said base portion to said butted roof joists;

second attachment means for attaching said side walls to non-butted roof joists so that all of the roof joists radiate out from said joint;

a rigid eave bracket including a flat, generally rectangular base having opposite side edges and an end edge and a pair of spaced-apart parallel side walls extending orthogonally from said base side edges;

third attachment means for attaching the eave bracket base to the butt end of a support beam;

fourth attachment means for attaching said eave bracket side walls to a roof joist so that the roof joist is oriented at an acute angle with respect to the butt end of the support beam;

a rigid stretcher bracket including a channel, said channel having a bottom wall and a pair of spaced-apart opposed parallel side walls extending from the bottom wall, said channel bottom and side walls having corresponding end edges at one end of the channel, said channel being arranged to snugly receive the end segment of a stretcher, means defining a notch in the end edge of the channel bottom wall, a base tab extending out from the end edge of one channel sidewall, and a second tab extending out from the end edge of the other channel side wall substantially perpendicular to said base tab so that said tabs can engage adjacent sides of a support beam received in said notch;

fifth attachment means for attaching said tabs to the sides of a support beam, and sixth attachment means for attaching said channel side walls to a stretcher.

* * * * *